United States Patent [19]

Gerber

[11] Patent Number: 4,546,764

[45] Date of Patent: Oct. 15, 1985

[54] POSTURAL DRAINAGE BED

[75] Inventor: James A. Gerber, Springfield, Oreg.

[73] Assignee: Invacare Corporation, Elyria, Ohio

[21] Appl. No.: 483,097

[22] Filed: Apr. 8, 1983

[51] Int. Cl.[4] ..... A61H 1/00

[52] U.S. Cl. ..... 128/33; 128/55

[58] Field of Search ..... 128/33–37, 128/55

[56] References Cited

U.S. PATENT DOCUMENTS

| | | | |
|---|---|---|---|
| 2,467,724 | 4/1949 | Baron | 128/33 |
| 3,042,025 | 7/1962 | Jackson | 128/33 |
| 3,088,457 | 5/1963 | Dersch | 128/33 |
| 3,638,646 | 2/1972 | Draux | 128/33 |
| 3,732,860 | 5/1973 | Thurmer | 128/33 |
| 3,752,154 | 8/1973 | Clark | 128/33 |
| 4,430,992 | 2/1984 | Christ | 128/33 |

*Primary Examiner*—Richard J. Johnson

*Attorney, Agent, or Firm*—Fay, Sharpe, Fagan, Minnich & McKee

[57] ABSTRACT

To eliminate excessive secretion from the lungs of a patient, percussion action of therapeutically effective frequency and amplitude is imparted to the patient's chest area. A bed top (10) is rotatably mounted on a base (20, 30). The bed top includes a frame (11), a head supporting section (17), a chest supporting section (16), and a lower body supporting section (15). A percussor (50, 52) is connected with the chest supporting section for providing the percussive action. The head supporting section includes upstanding shoulder engaging portions to either side thereof to engage the patient's shoulders to prevent the patient from being vibrated off the bed when the head end of the patient is tipped downward. The chest supporting section is mounted in vibrational isolation to the frame to reduce the amount of percussive action received by the patient's head and other portions of the body which may tend to cause nausea. The chest supporting section is mounted higher than the head and lower body supporting sections to focus the percussive action on the patient's chest area. The chest supporting section transfers the percussion action generally in proportion to the weight and body mass of the supported patient. A ball screw actuator (40) provides an effective one-way transmission for rotating the bed top relative to the base.

10 Claims, 7 Drawing Figures

POSTURAL DRAINAGE BED

BACKGROUND OF THE INVENTION

With certain respiratory disorders, such as emphysema, asthma, cystic fibrosis, and chronic bronchitis, mucous and other secretions build up to excessive levels in the bronchial passages of the victim's lungs. It is desirable, and sometimes essential, that this excess secretion be substantially removed from the lungs to enable the affected person to breathe more easily.

One method of treating such persons involves tapping forcefully the chest and shoulders of the affected person to loosen the accumulated secretion. The person applying such treatment requires special training in order to be able to apply the appropriate amount of pressure and frequency of tapping. Sometimes such manual treatment is carried out with the patient lying on a table that is tilted upward from the foot area to raise the patient's feet above the level of his head thereby enhancing the flow of loosened secretion from the patient's lungs to his throat area where it can be expelled by clearing of the throat.

It is also known to employ hand held devices that vibrate to apply vibration to appropriate areas of the patient's chest. One such hand held device is described in U.S. Pat. No. 4,079,733.

It is also known to treat such patients by employing a table that tilts upward from the foot area thereof and employing means which imparts vibration to the entire table top. Such a device is described in U.S. Pat. No. 3,752,154.

It is an object of the present invention to provide a postural drainage bed that is simple in construction and operation, and is of an enhanced efficacy in treating patients with excessive secretion accumulation in their lungs.

Other objects will be apparent from the following description of the preferred embodiment of the postural drainage bed of the present invention.

SUMMARY OF THE INVENTION

This invention comprises an apparatus for providing an enhanced percussion treatment of patients with excessive secretion accumulation in their lungs by providing a postural drainage bed that concentrates the percussion action in the area of the patient's chest while tilting the patient at an angle to the horizontal whereby the patient's head is lower than the rest of his body.

The postural drainage bed of the present invention has a body supporting top that is divided into at least three discrete sections, one of the sections being in a location to support the patient's chest area as the patient lies face down on the bed. Means are provided to impart a percussion action of a therapeutically effective frequency and amplitude to the chest supporting section, and means are further provided to confine the percussion action essentially to the chest supporting section.

Means are provided for tilting the postural drainage table top from an essentially horizontal position to a position where the head supporting section is lower than the lower body supporting section.

DESCRIPTION OF THE PREFERRED EMBODIMENTS

Figure 1:
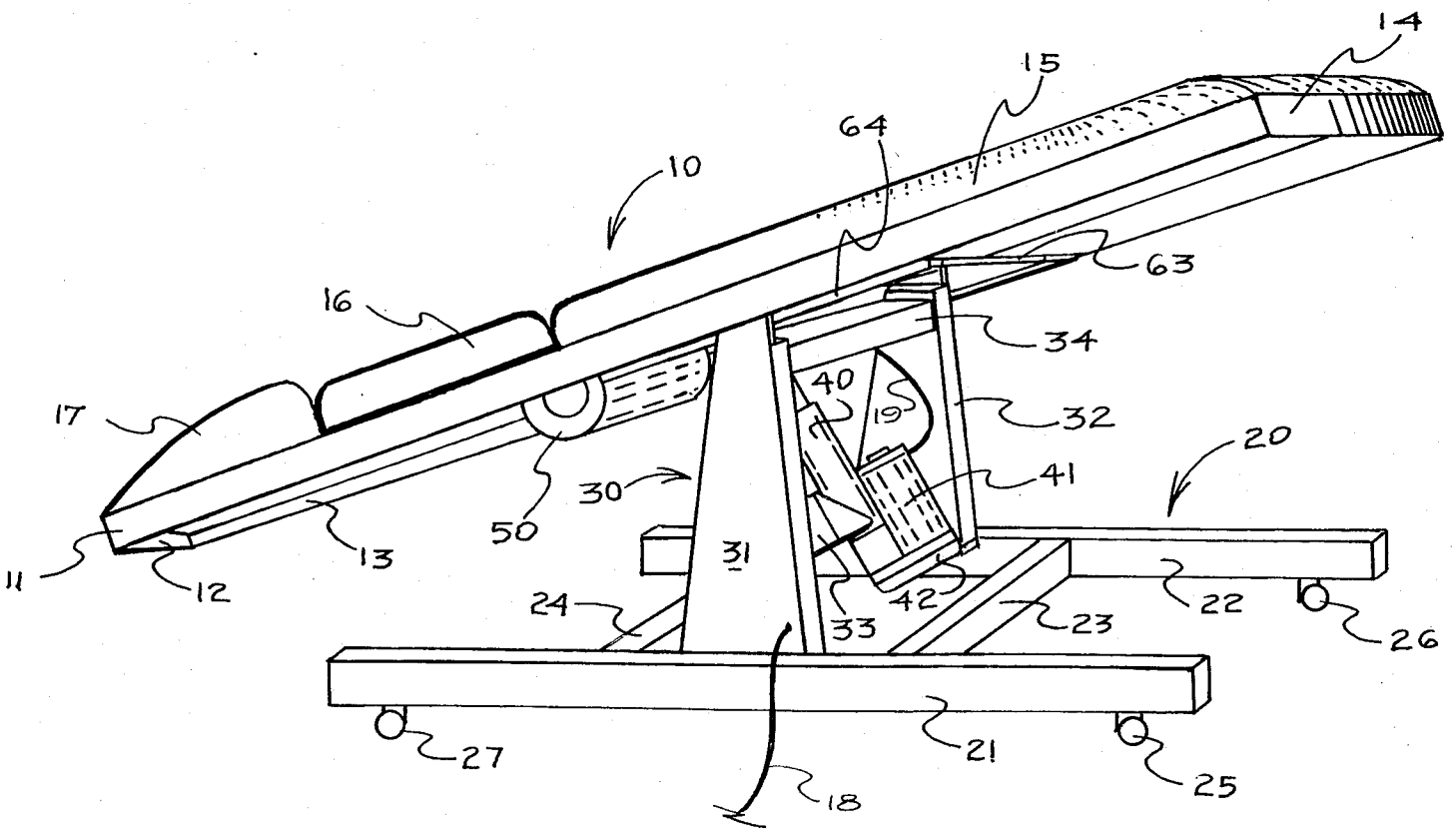
FIG. 1 is a left side perspective view of the postural drainage bed of the present invention.
Figure 2:
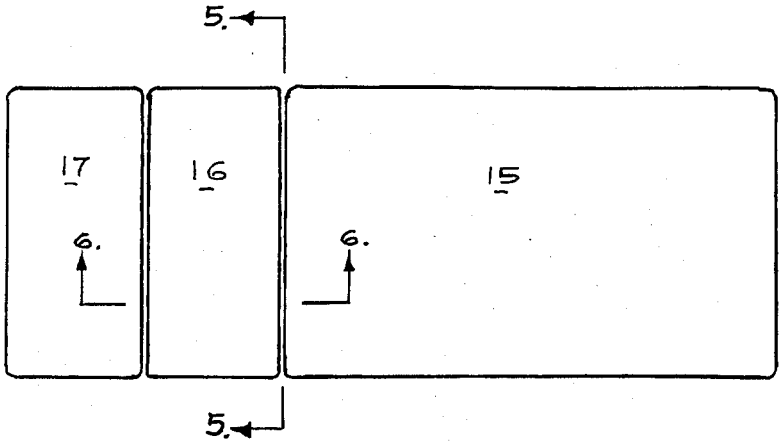
FIG. 2 is a top view of the postural drainage bed.

Referring to the drawings, and particularly to FIG. 1, the postural drainage bed is generally comprised of a top 10, a base 20, and a pedestal 30 which supports bed top 10 upon base 20.

Bed top 10 is comprised of a rectangular frame which includes a left longitudinal top frame member 11, front end transverse frame member 12, right longitudinal top frame member 13, and a rear end transverse top frame member 14. Additional intermediate frame members, such as member 66 shown in FIG. 7 and members 72 and 73 shown in FIG. 6 may also be employed.

Mounted upon the top frame, in a manner to be described, are three body supporting sections, one for each of the head, chest, and lower body portion of a patient to be treated. The lower body supporting section cushion 15 is located at the rear end of bed top 10, the chest supporting cushion 16 is located in an intermediate area of bed top 10, and the head supporting section cushion 17 is located at the front end of bed top 10.

Cushions 15, 16, and 17 are constructed in a manner well known in the art, and are comprised of an outer upholstery material, such as vinyl, a resilient interior material, such as polymeric foam, and a base of a rigid material, such as plywood. Cushions 15 and 17 are firmly attached to top frame members 11, 12, 13, and 14 by screws or other suitable fastening means, not illustrated. Chest supporting cushion 16 is attached to the bed top frame members 11 and 13 by a resilient supporting system in a manner to be described.

Base 20 is comprised of a left side longitudinal beam 21, a right side longitudinal beam 22, a rear transverse beam 23, and a front transverse beam 24. Longitudinal beam members 21 and 22 of base 20 have caster wheels mounted thereon, only three of which, 25, 26, and 27 are illustrated in FIG. 1, to thereby permit the postural drainage bed to be easily moved from one location to another. The caster wheel not illustrated is located in the same position on beam 22 as wheel 27 is located on beam 21.

Pedestal 30 is comprised of a left vertical stanchion 31, a right vertical stanchion 32, a lower cross brace 33, and an upper cross brace 34. Cross brace 33 is inclined at an angle to the horizontal, as illustrated in FIG. 1. Rotatably mounted on lower cross brace 33, by means of a clevis or other suitable means, is electric ball screw actuator 40.

Electric ball screw actuator 40 is comprised of the usual cylinder and ball screw (piston) arrangement, and has associated therewith an electrical motor 41 mounted upon a common base 42. The outer end of the piston of ball screw actuator 40 is attached to the underside of bed top 10 in a manner to be described.

One of the features of the present invention is that the percussion imparted to the postural drainage bed is substantially confined to the chest supporting section 16 of bed top 10. Thus, the therapeutic percussion action is concentrated and confined to the chest area and not dissipated over the entire table top. This is accomplished by segregating the portion of the bed top supporting the chest area from the remainder of the bed top and by mounting the percussion generating means so as to impart vibration directly to the chest supporting section. These features are best understood by reference to FIGS. 5 and 6.

Figure 5:
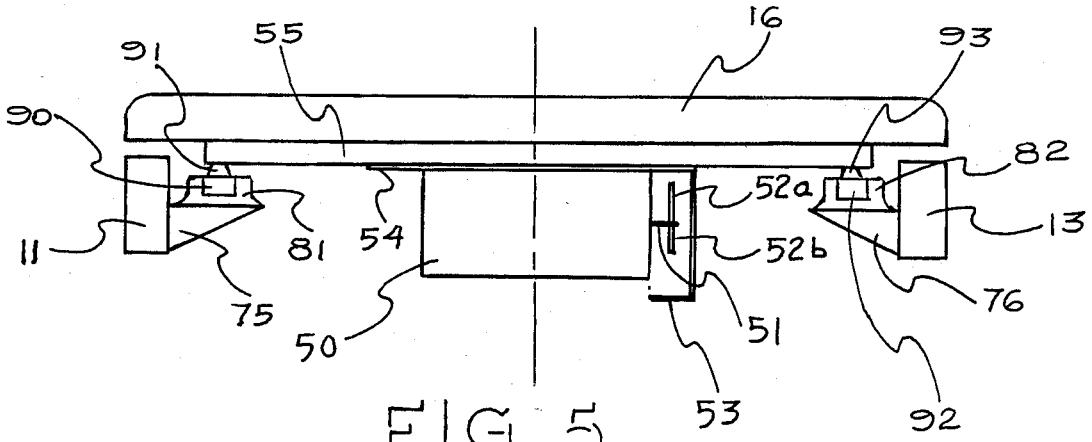
FIG. 5 is a view of the chest supporting section of the top of the postural drainage bed taken along line 5—5 of FIG. 2.
Figure 6:
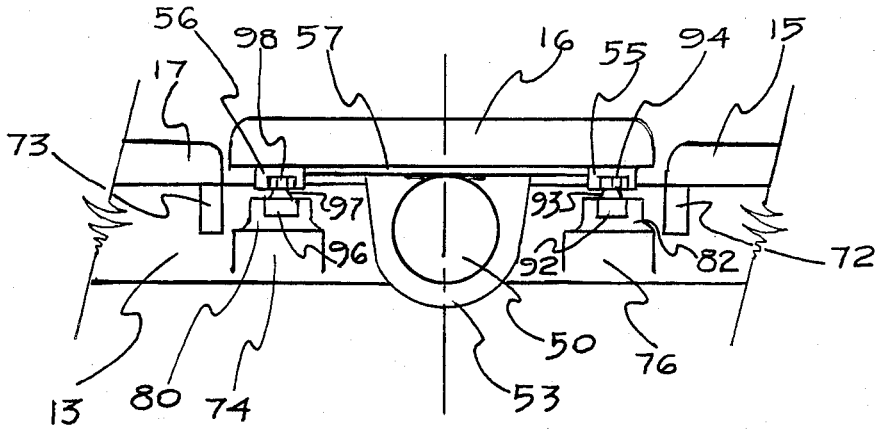
FIG. 6 is a left side view of the chest supporting section of the top of the postural drainage bed taken along line 6—6 of FIG. 2.

As seen in FIGS. 5 and 6, the percussion generating means of the present invention is comprised of a motor 50, preferably electric, having a drive shaft 51 to which is eccentrically mounted a rotor 52. In the preferred embodiment illustrated, rotor 52 is a rectangular bar having a long arm 52*a* and a short arm 52*b*. A guard or shield 53 surrounds rotor 52, and the motor 50 and guard 53 are attached to mounting plate 54. Mounting plate 54 is attached to the rigid panel forming the underside of cushion 16 in any suitable manner, such as by the use of screws.

The percussion action generated by motor 50, drive shaft 51 and rotor 52 is comprised of two waveform components: frequency, and amplitude or intensity. The frequency component of the percussion action is determined by the motor speed, i.e., the velocity of drive shaft 51, and the amplitude or intensity of the percussion action is determined by the horsepower of motor 50, the length of rotor 52, and the ratio of the length of long arm 52*a* to short arm 52*b*.

It is the current opinion of the medical profession that a therapeutically effective percussion frequency is between about 25 and 35 cycles per second. To provide a frequency within such range, a motor 50 should be selected which has a motor speed (i.e., the radial velocity of the drive shaft) between about 1500 and 2100 revolutions per minute. In the preferred embodiment of the present invention the motor 50 has a motor speed of 1720 revolutions per minute.

A therapeutically useful amplitude or intensity of percussion depends to a certain extent upon the size of the patient to be treated. It has been found that a generally useful amplitude or intensity is generated if motor 50 is selected to produce 1/6th horsepower, rotor 52 is a generally rectangular-shaped bar having width of about 1.0 inch, an overall length of between about 1.18 and about 1.25 inches, a long arm 52*a* length of about 1.0 inch and a short arm 52*b* length of between about 0.18 and about 0.25 inch. The preferred short arm 52*b* length is 3/16 inch. It is to be understood, however, that while the foregoing represents a preferred set of parameters for providing a therapeutically useful amplitude or intensity of percussion, that other motor sizes associated with a different set of rotor size or shape parameters could be selected to achieve the same results. For example, the motor 50 could have a size between about 1/16th and about ¼th horsepower. It is also within the contemplation of the present invention that interchangeable rotors of varying size could be provided to permit adjustment of the percussion intensity to accommodate patients requiring a different intensity to be more therapeutically effective.

Located on the underside of chest area support cushion 16 is a frame for use in resiliently mounting cushion 16 on the frame of bed top 10, in a manner to be described, comprised of transverse frame members 55 and 56 and longitudinal frame members located on the right and left sides of cushion 16 perpendicular to frame members 55 and 56, only one of which longitudinal frame members, member 57, is shown in FIG. 6. Frame members 55, 56, and 57 are attached to the underside of cushion 16 by any suitable fastening means, such as screws.

Figure 3:
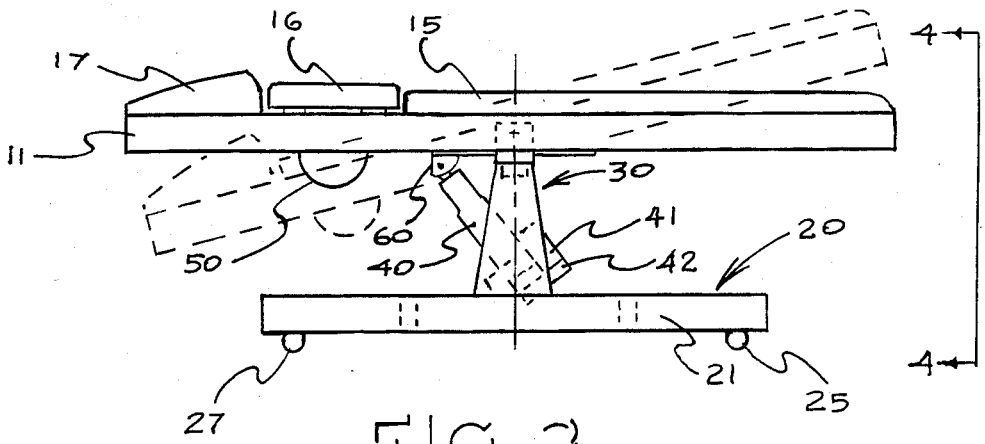
FIG. 3 is a left side view of the postural drainage bed showing it in its normal horizontal position, and, in phantom, the bed in its tilted, treating position.

The postural drainage bed of the present invention is designed to tilt about an axis of rotation located at the center of the bed top, as illustrated in FIGS. 1 and 3. To accomplish this desired tilting action, a tilt frame is located beneath the lower body supporting cushion 15, and is best seen by reference to FIG. 7. The tilt frame is comprised of a rear transverse frame member 62, a front transverse frame member 63, a left longitudinal frame member 64, and a right longitudinal frame member 65. Clevises 60 and 61 depend from rear transverse frame member 62 for attachment to the outer end of the piston of ball screw actuator by use of a pin in a manner well known in the art.

Figure 7:
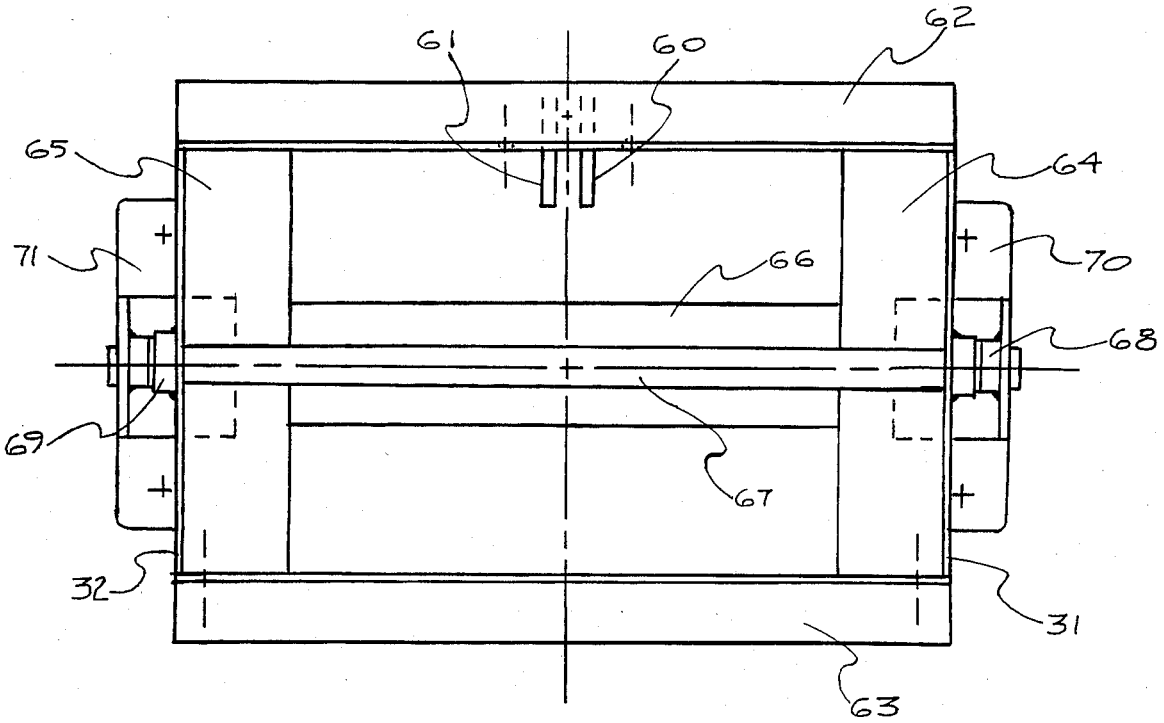
FIG. 7 is a view of the underside of the postural drainage bed in the area of the axis of rotation.

The upper portions of the outside panels forming a part of stanchions 31 and 32 extend into adjacent proximity to the inner face of longitudinal top frame members 11 and 13, as can be seen by reference to FIG. 1. A shaft 67 extends through the upper portions of stanchions 31 and 32, as shown in FIG. 7 into journal bearings 68 and 69. Journal bearings 68 and 69 are supported by left and right journal bearing support members 70 and 71 which are fixed to the upper portions of stanchions 31 and 32, respectively.

As mentioned previously, it is desirable that chest supporting cushion 16 be supported on the frame of bed top 10 by a resilient supporting means. Such a resilient supporting means helps confine the percussion imparted to cushion 16 to the chest area and lessens considerably the transmission of such vibration to the head and lower body supporting cushions 15 and 17.

The resilient supporting mechanism for chest supporting cushion 16 is best understood by reference to FIGS. 5 and 6. The supporting means is comprised of at least four mounting brackets, only three of which, 74, 75, and 76 are illustrated, which are attached to the inside of longitudinal frame members 11 and 13 by any suitable means, such as welding. Attached to mounting brackets 74, 75, and 76, respectively, are hollow support base members 80, 81, and 82. Between each hollow support base member 80, 81, and 82, and adjacent frame members 55 and 56, are located resilient pad members 97, 91, and 93, respectively. Suitable fastening members pass through each of pad members 91, 93, and 97 to attach frame members 55 and 56 to the hollow base support members 80, 81, and 82. Such suitable fastening members may be nuts and bolts, such as nuts 91, 92, and 96 with associated bolts. Only two such bolts, 94 and 98, are illustrated, bolts 94 and 98 being associated with nuts 92 and 96, respectively. It is to be understood that there are at least four such identical supporting means, one being located at each corner of cushion 16, but that only three are illustrated.

OPERATION OF THE PREFERRED EMBODIMENTS

Figure 4:
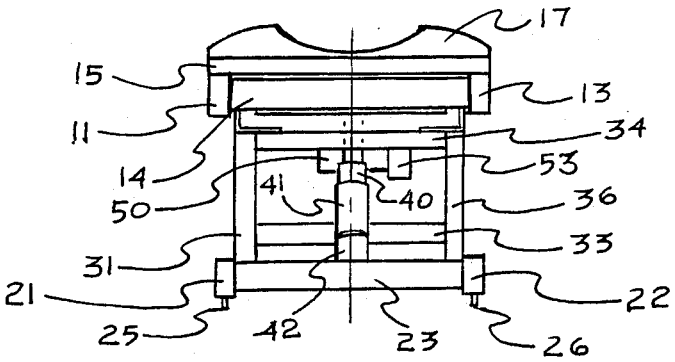
FIG. 4 is a rear end view of the postural drainage bed.

In operation, a patient lies face down on the postural drainage bed top 10. Head supporting cushion 17 is generally U-shaped, as best seen in FIG. 4, to accommodate the patient's neck. The patient's chest rests on chest supporting cushion 16, and his legs and lower body on cushion 15.

Bed top 10 is initially in the horizontal position shown in FIG. 3 where it remains until the patient is comfortably positioned thereon for treatment.

Power cord 18 is plugged into a power outlet and conducts electricity to the motor of ball screw actuator 40 via a switch (not shown) and power cord 19, as seen in FIG. 1.

The ball screw actuator 40 is then actuated to lower the patient's head below his feet level, as shown in phantom in FIG. 3.

Percussion generating motor 50, which is connected to the power source via cord 18 and a switch and cord not shown, is actuated which causes chest supporting cushion 16 to percuss at a frequency and intensity that is therapeutically effective to loosen excessive secretion that have accumulated in the patient's lungs.

It is to be understood that while the preferred embodiments of the present invention have been described, variations in the particular features illustrated may be employed to achieve the desired results disclosed herein.

I claim:

1. A postural drainage bed comprising:

a base;

a frame;

a bed top, said bed top being positioned on said frame and said frame being pivotally mounted on said base to be selectively tipped relative to horizontal;

means for tilting said frame relative to said base and for holding said frame in a tilted position;

a discrete chest supporting section operatively connected with the frame;

a head supporting section operatively connected with the frame, the head supporting section including a central patient neck receiving portion and a pair of side portions extending more upwardly than the neck receiving portion and the chest supporting section such that the side portions may engage shoulders of a patient lying face down on the bed top when the frame is tipped downward;

a separate lower body supporting section operatively connected with the frame;

means for imparting a percussion action having a therapeutically effective frequency and amplitude only to said chest supporting section; and, means supporting said chest supporting section which essentially confines and isolates said percussion action to said chest supporting section.

2. The postural drainage bed of claim 1 wherein said means for imparting a percussion action to said chest supporting section includes a motor mounted on the underside of said chest supporting section, said motor having a drive shaft with a rotor eccentrically mounted thereon.

3. The postural drainage table of claim 2 wherein said motor has a drive shaft velocity of between about 1500 and about 2100 revolutions per minute.

4. The postural drainage bed of claim 2 wherein said rotor is a rectangular bar having a long arm and a short arm.

5. The postural drainage bed of claim 4 wherein the length of the long arm is about one inch and the length of the short arm is between about 0.18 to about 0.25 inch.

6. The postural drainage bed of claim 1 wherein said support means for said chest supporting section includes a least four resilient cushioning members, each of which is located in close proximity to one of the corners of said chest supporting section and between the underside thereof and said table top frame.

7. A postural drainage bed comprising:

a base;

a frame pivotally mounted with said base;

a separate head supporting section operatively connected with the frame and defining an upper patient head supporting surface;

a chest supporting section defining an upper patient chest supporting surface;

a separate lower body supporting section operatively connected with the frame and defining an upper patient lower body supporting surface;

chest section mounting means for mounting the chest section with the frame in vibrational isolation therewith and mounting the chest supporting surface higher than the head and lower body supporting surfaces such that a patient's upper body is supported primarily by the higher chest supporting surface; and, means for imparting a percussion action having a therapeutically effective frequency and amplitude only to the chest supporting section, whereby the percussion action is isolated from the head and lower body supporting sections and imparted primarily to the patient's chest and nausea caused by percussion action to the patient's head is avoided.

8. A postural drainage bed comprising:

a base;

a frame pivotally mounted on the base;

tilting means for tilting the frame relative to the base and for selectively holding the frame in a tilted position;

a separate head supporting section positioned on and operatively connected with the frame;

a chest supporting section which transfers percussive action therethrough;

a separate lower body supporting section positioned on and operatively connected with the frame;

chest section mounting means for mounting the chest section with the frame in vibrational isolation therefrom; and, means for imparting a percussion action having a therapeutically effective amplitude and frequency only to the chest supporting section.

9. The bed of claim 8 wherein the chest supporting section comprises a rigid base which is operatively connected with the percussion means and a compressible, foam cushion.

10. The postural drainage bed as set forth in claim 11 wherein the tilting means includes;

a ball screw actuator having a piston and cylinder, an outer end of the ball screw actuator being attached to said frame at a location displaced from a pivot axis and an inner end of the ball screw actuator being operatively connected with the base, the ball screw actuator providing one-way transmission of mechanical motion from a motor to the frame and essentially preventing transmission of mechanical motion from the frame to the motor, such that the ball screw actuator fixes the rotational orientation of the frame without a supplement lock.

* * * * *